United States Patent [19]

Olson

[11] 4,441,718

[45] Apr. 10, 1984

[54] BIBLICAL GAME

[76] Inventor: Mark J. Olson, 1909 Woodlyn Dr., Apt. 104, Fredericksburg, Va. 22401

[21] Appl. No.: 297,081

[22] Filed: Aug. 27, 1981

[51] Int. Cl.[3] ..... A63F 3/04

[52] U.S. Cl. .....273/242; 273/254

[58] Field of Search ..... 273/255, 262, 254, 242

[56] References Cited

U.S. PATENT DOCUMENTS 3,756,604 9/1973 Laszlo ..... 273/255
4,200,293 4/1980 Benson ..... 273/262

OTHER PUBLICATIONS

*Advanced Dungeons and Dragons Dungeon Masters Guide,* 1979 Gary Gygax.
*Kingmaker* Avalon Hill Game Co., c. 1976 pp. 1–12.
*Bismark* The Avalon Hill Game Co. c. 1979, pp. 2–4, 26.

*Primary Examiner*—Richard C. Pinkham
*Assistant Examiner*—Scott L. Brown
*Attorney, Agent, or Firm*—Cushman, Darby & Cushman

[57] ABSTRACT

An educational game primarily for the simulation of the spread of the Bibical New Testament gospel throughout the Roman Empire. A game board has indicia associated with various playing spaces, representing cities, ports, and land and sea routes. A plurality of moveable game pieces representing Apostles are provided for movement around the game board, at least two game pieces for each participant. Each participant is provided with as many player boards as he has moveable game pieces, each player board having indicia thereon associated with a corresponding game piece. Each game piece is assigned a movement factor which is used to advance the piece around the game board. Moreover, each game piece is assigned other "ability factors" which, when compared to the roll of dice, may allow an Apostle to establish and build churches. Other playing markers and chips (having different indicia thereon) are employed to keep track of each participant's progress and accomplishments. Two sets of chance means (embodied in cards and having indicia thereon corresponding to the plight of converts, Apostles, and churches) are provided for competition against the participants collectively, as each player cooperates with the others. At the end of a designated number of game turns, the number of converts and deacons "won" during the game is counted and victory or defeat for the players is proclaimed.

13 Claims, 8 Drawing Figures

BIBLICAL GAME

BACKGROUND AND SUMMARY OF THE INVENTION

The present invention relates to educational games in general and in particular to religious ones, this one having the objective of simulating the spread of the gospel throughout the Roman Empire according to the book of Acts of the Bible. Hence I have named the game "GOSPEL EXPLOSION: The Acts of the Apostles". The game may be played by one to six participants, and all participants work together to try to defeat the board with all of its chance elements.

Board games which attempt to simulate historical events are not novel. Especially prevelant on the market today are games which simulate warfare. Two such games designed and copyrighted by the Avalon Hill Company are "1776" and "Blitzkrieg." War games typically involve a mixture of strategy and chance and provide competition between players. There is a need to provide similar type games in different areas but in which the emphasis is on having the players work together to reach a desired result. The present invention provides such a game.

Games which utilize a board depicting a map of at least part of the world have been disclosed in the prior art, for example, in U.S. Pat. Nos. 387,220; 952,997; 1,579,327; 3,368,816; 3,942,800; and 4,216,967. Such games cover a wide variety of subjects such as presidential election games, war games and archeological games and may be educational and/or entertaining. Educational games are generally directed to a specific segment of the population, and their success depends in large part upon the game's educational value, variety in the play, appeal to various age groups, and the use of a good combination of luck and skill. This invention meets these requirements for a successful educational game.

One of the important principles in the game according to the present invention is the use of a player board, distinct from the game board, for each moveable game piece. These player boards allow for movement of the game pieces (representing the New Testament Apostles) and for the winning of "converts" and "deacons" by the Apostles. One chance means is employed to aid or hinder the Apostles as they try to establish and build churches; another chance means, utilized each time an Apostle wins one or more converts, may present conflicts for the participants to resolve. No other educational or entertaining game has this combination of components, and it is believed that this game has a successful combination.

The game according to the present invention in detail utilizes a game board with a plurality of consecutive hexagonal playing spaces thereon (having indicia associated therewith), a plurality of moveable game pieces for movement across the board, a plurality of player boards (one for each moveable game piece), a plurality of marker pieces for the game board, and a plurality of chips for the game board. At least two different indicia are provided for distinguishing two distinct types of markers as well as chips. Moreover, the indicia on the chips correspond to point values for those pieces. Chance means are provided for aiding or hindering the Apostles as they try to establish and build churches; another chance means allows for the loss of converts through conflicts. Preferably, both of these chance means are cards, which are distinguishable by the indicia thereon. Dice and charts are employed to determine how many converts are "won" on a particular game turn. Players work together to try to establish and build as many strong churches as possible in order to spread the gospel throughout the Roman Empire within the 40 years (or 20 game turns) that the game spans. Competition is provided by the game itself, through the chance cards and dice, and the players are constantly striving to beat the odds and overcome persecution, just as the early Christians had to do. The hexagonal playing spaces on the game board are disposed in a plurality of continuous paths, forming both land and sea routes, having one space thereof indicating the starting point for six of the Apostles. The other six Apostles enter the game at various cities and at different stages of the game, depending upon how fast and where the first six Apostles are spreading the gospel. After all Apostles who have entered the game have taken their turns, one game turn has been completed. At the end of twenty game turns, the total number of converts and deacons is totalled to determine whether or not the participants have in fact defeated the board.

It is the primary objective of the present invention to provide an educational game which is enjoyable to those of all ages and which simulates the growth of Christianity throughout the Roman Empire. Inspection of the detailed description of the invention and of the claims will reveal this and other objectives of the invention.

DETAILED DESCRIPTION

Figure 1A:
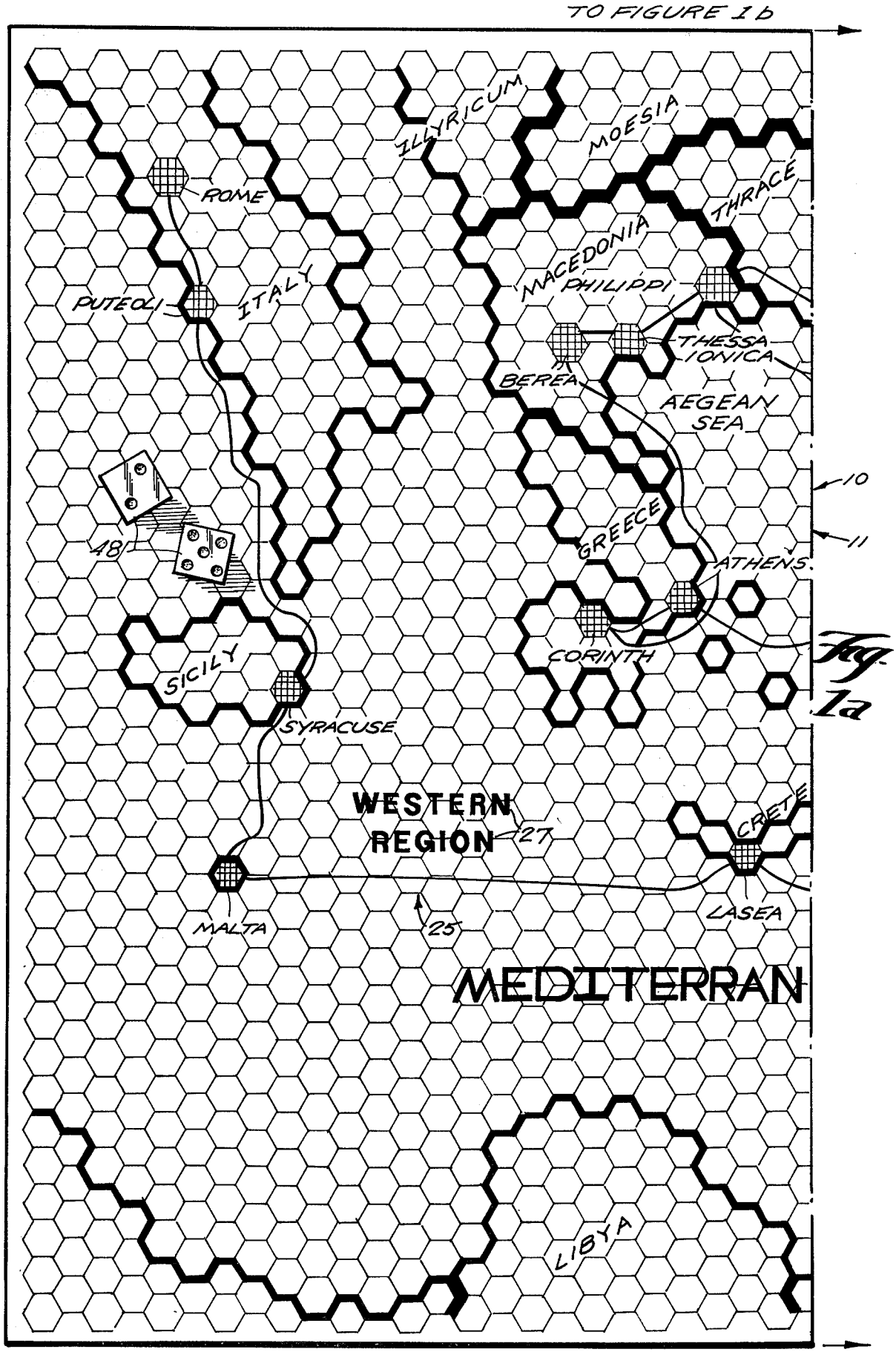
FIGS. 1*a* and 1*b* are a top plan view of an exemplary game board according to the present invention.
Figure 1B:
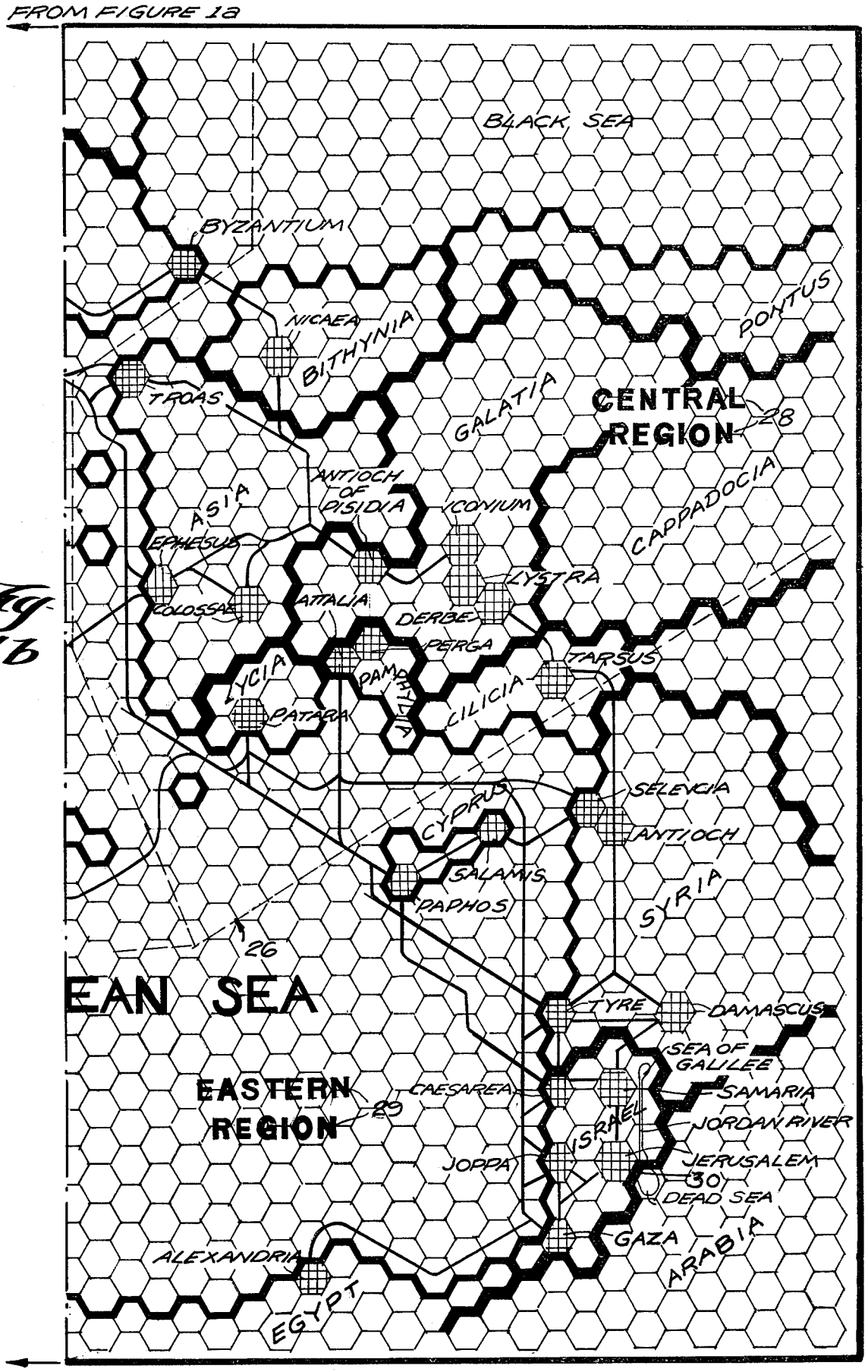
Figure 2:
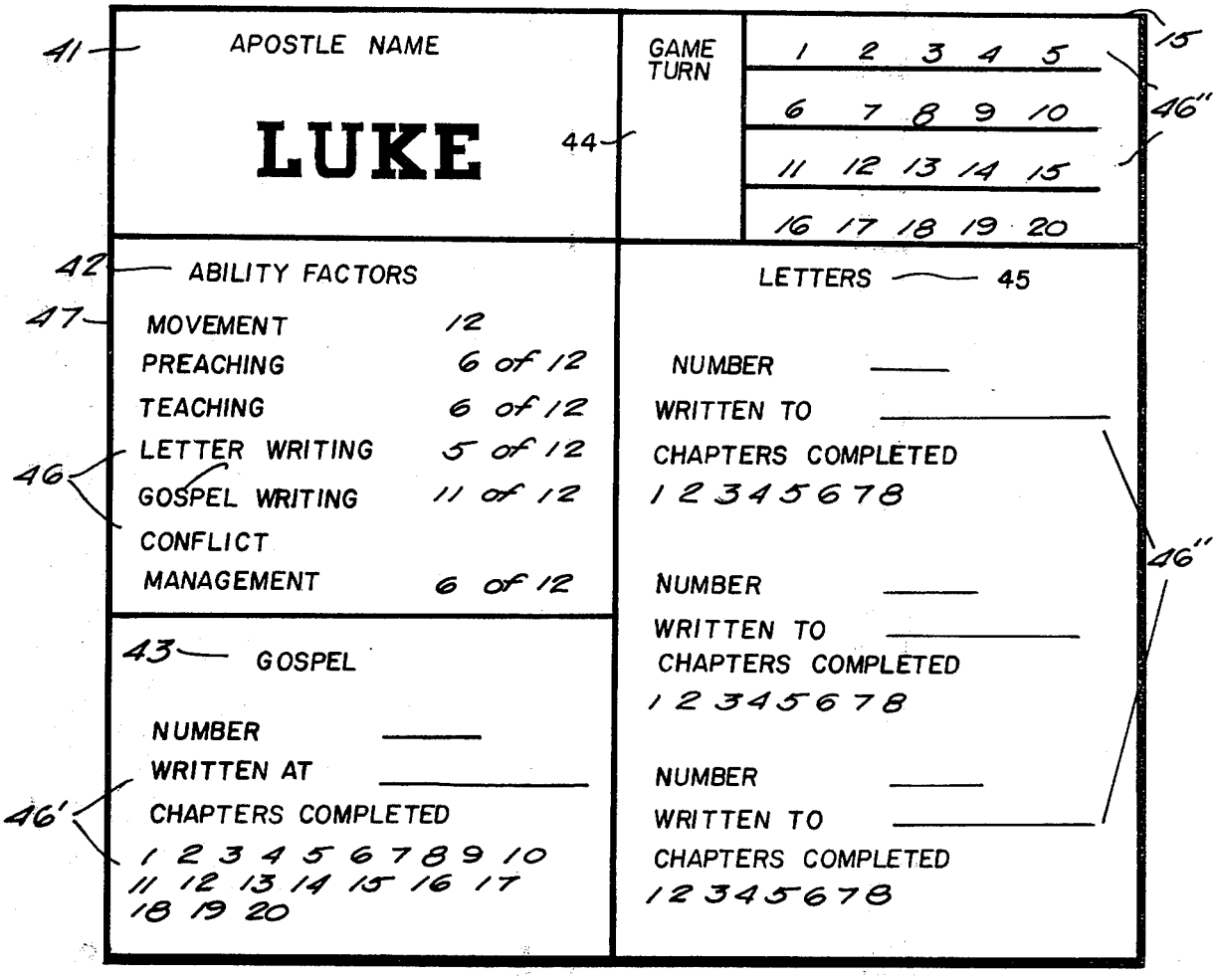
FIG. 2 is a top plan view of an exemplary player board.
Figure 5:
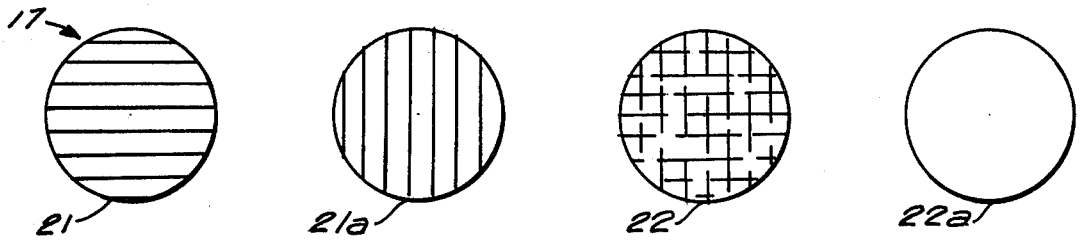
FIG. 5 is a top plan view of exemplary tallying pieces, and FIGS. 6A and B are top plan views of two distinct types of exemplary chance means for losing or gaining tallying pieces.
Figure 3:
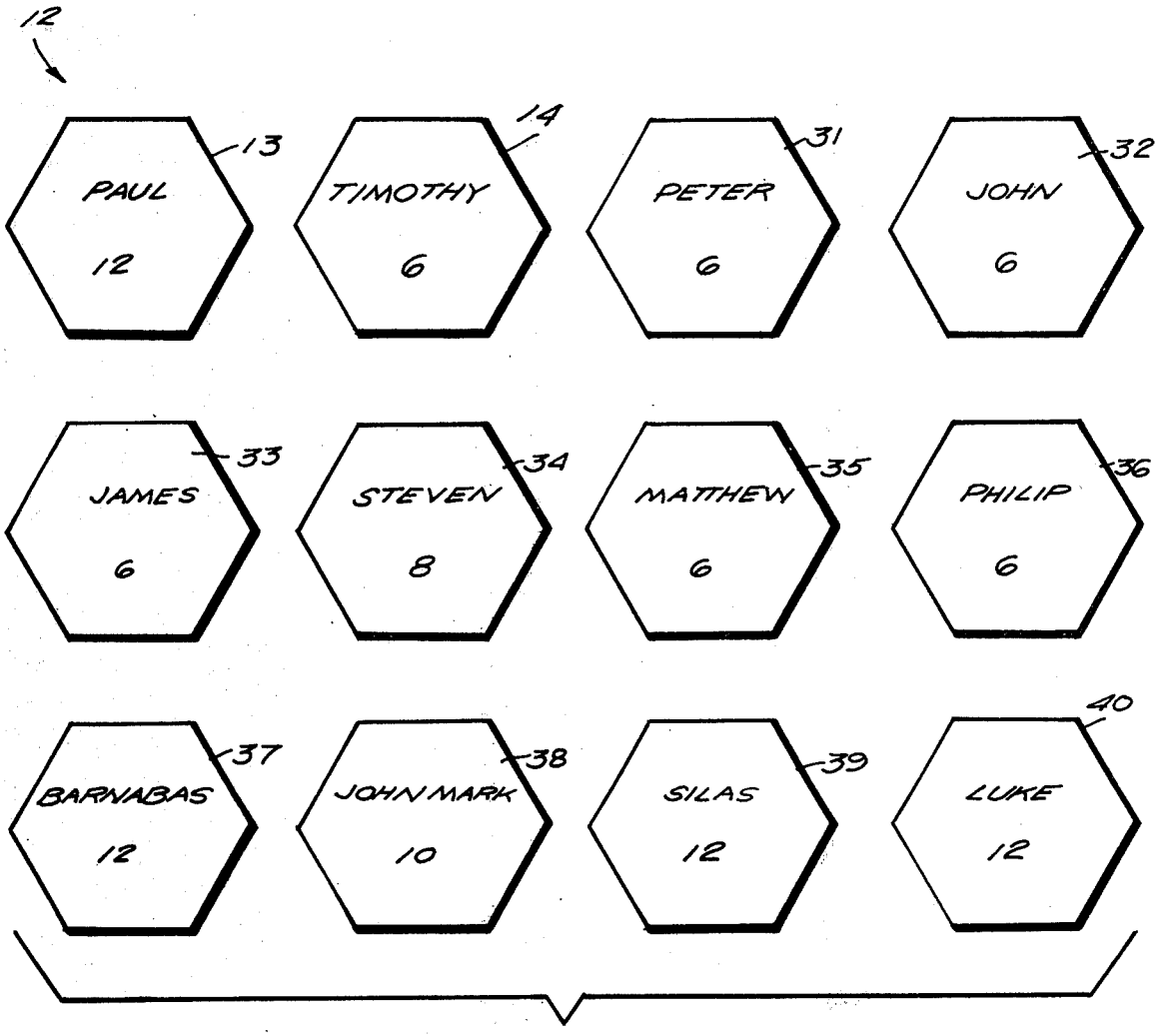
FIG. 3 is a top plan view of the twelve game pieces.
Figure 6A:
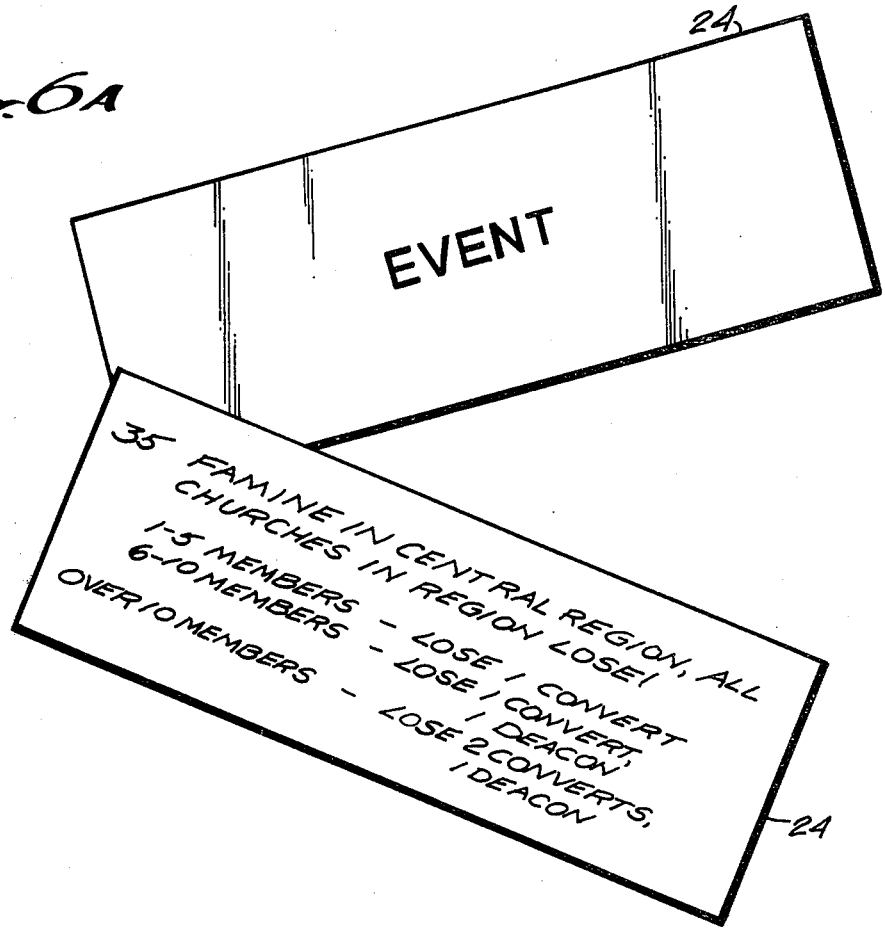
Figure 6B:
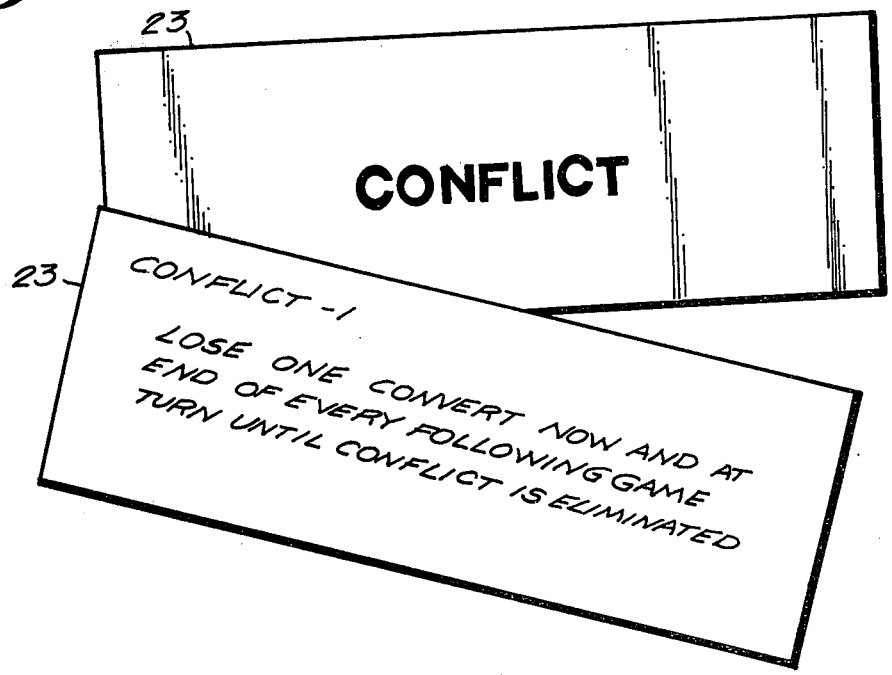

FIGS. 1*a* and 1*b* illustrate the top plan view of the game board 10 having contiguous hexagonal playing spaces 11 arranged thereon throughout its width and breadth, having indicia associated therewith. In FIG. 3, a plurality of moveable games pieces 12 (at least two for each participant) are provided for movement around the board. Each game piece 12 has at least two different indicia for distinguishing two distinct types of moveable game pieces such as 13 and 14. A plurality of player boards 15, one for each moveable game piece, are also provided as shown in FIG. 2. Markers 16 and chips 17 (FIGS. 4 and 5) are provided for keeping track of the events in the game. Each marker has different indicia associated with it, at least two different indicia being provided for distinguishing two distinct types of pieces, such as 18, 19 and 20 (markers) and 21 and 22 (chips). Chance means 24 as shown in FIG. 6A are provided at the end of each game turn to aid or hinder the participants from gaining chips 17. Other chance means 23 (FIG. 6B) are provided for inflicting conflicts on a game piece 12, immediately after that game piece 12 gains one or more chips 17 in an individual game turn.

In the preferred embodiment, the game board 10 is a conventional type game board that may be folded in half. As shown in FIG. 1*a*, the hexagonal playing spaces 11 preferably form a plurality of continuous paths, comprising both land and sea routes 25 for travel across the game board. The game board is divided into three sections by dotted lines 26, and each section is identified by indicia such as "Western Region" 27, "Central Region" 28, and "Eastern Region" 29. Many cities such as 30 are identified, and the one marked "Jerusalem" indicates the start of play for six designated game pieces 31, 32, 33, 34, 35 and 36. The remaining six game pieces, 13, 14, 37, 38, 39, 40 enter later in the game. These moveable game pieces 12 may comprise any shape and size, but their preferred form is one in which they just fit within the boundaries of the individual hexagonal playing spaces 11. Preferably the indicia distinguishing between game pieces 12 are numbers and letters. For instance, as shown in FIG. 3, one game piece 13 has the name "Paul" and the number "12" (his movement factor) as identifying indicia whereas another game piece 14 has the name "Timothy" and number "6" as indicia associated thereon. Preferably, all game pieces 12 are of the same color.

The player boards 15 (FIG. 2) are preferably sheets of paper, which may be reused to save money. Preferably each board is divided into five different sections, an Apostle Name section 41, an Ability Factors section 42, a Gospel section 43, a Game Turn section 44 and a Letters section 45. All but the Apostle Name section 41 have different indicia 46, 46' 46'', 46''' associated with each row 47. Each row indicates something different, according to the section of the player board 15 on which it lies. For instance, as shown in FIG. 2, the section entitled "Ability Factors" 42 has six rows associated therewith each having different indicia 46 corresponding to the abilities of that particular Apostle.

Figure 4:
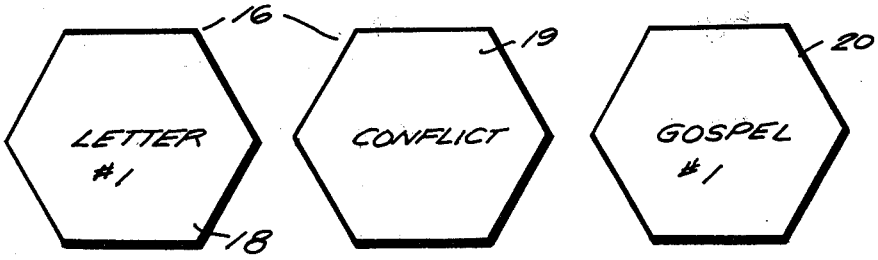
FIG. 4 is a top plan view of exemplary marker pieces.

At least two different indicia are provided for distinguishing between two distinct types of marker pieces, as shown in FIG. 4, wherein three different indicia provide for three different types of marker pieces 16 respectively designated 18, 19 and 20. Preferably, the indicia distinguishing between the marker pieces 16 are colors and letters. For instance, a plurality of marker pieces 18 are of pink color with identifying indicia "Letter" associated therewith; a plurality of marker pieces 19 are of yellow color with "Conflict" marked thereon; and a plurality of marker pieces 20 are of green color with "Gospel" written thereon.

At least two different indicia are used to distinguish between distinct types of tallying pieces or chips 17. In FIG. 5, four different indicia provide four different types of tallying pieces 21, 21*a*, 22 and 22*a*. Preferably the indicia distinguishing between the tallying pieces (chips) are colors providing a weighting factor. In the preferred embodiment, chips 21 and 21*a* are related such that three chips 21 of blue color are equivalent to one chip 21*a* of red color. Likewise, three chips 22 of yellow color are equivalent to one chip 22*a* of white color.

A deck of Conflict cards 23 (FIG. 6B) may also be provided, each card 23 either being blank or having printed on one face indicia corresponding to an event having negative connotations. In the preferred embodiment, these cards 23 represent persecution to the Christians, and they often cause a church to lose converts or an Apostle to be martyred. In addition to the Conflict cards, Event cards 24 (FIG. 6A) may also be provided, each card having printed on one face indicia corresponding to either positive or negative events. In the case of the occurrence of a positive event, converts are added to the churches; when a negative event occurs, Christians are persecuted and converts are lost. In the preferred invention, dice 48 and various charts are used to determine how fast a church grows; often these chance means, Conflict cards 23 and Event cards 24, will help or hinder such growth.

Exemplary apparatus according to the present invention is set forth, and exemplary rules of the game and method of play are now set forth.

RULES OF THE GAME AND METHOD OF PLAY

It is understood that the rules of the game and the method of play are subject to wide variation, the principle factor being the spread of an idea (e.g., a particular religion or cause) throughout a designated area on a game board 10. One set of rules embodying this principle for the spread of the New Testament gospel throughout the Roman Empire is as follows:

The game is played on a game board of the Ancient Mediterranean World 10. Each player is given several playing pieces 12 representing Apostles, early leaders in the Christian church. He moves these around the board winning converts and establishing churches as quickly as possible. Unlike most games, players do not compete against each other. They cooperate as the early Apostles did to spread Christianity throughout the world. Competition is provided by the game itself, through two sets of cards, many of which inflict persecution or misfortune upon the various churches and Apostles. An intelligent group of players, cooperating with each other, can overcome this opposition and successfully spread Christianity throughout the Roman Empire, thus winning the game.

There are 12 Apostles to be divided among the players. The following Chart A summarizes the appropriate division of Apostle pieces:

CHART A

DIVISION OF APOSTLE PIECES

| TWO PLAYERS | | THREE PLAYERS | | |
|---|---|---|---|---|
| #1 | #2 | #1 | #2 | #3 |
| Peter | Paul | Peter | Paul | John |
| Timothy | Philip | Timothy | Philip | Steven |
| John Mark | Matthew | John Mark | Matthew | Silas |
| James | Barnabas | James | Barnabas | Luke |
| Silas | John | | | |
| Steven | Luke | | | |

FOUR PLAYERS

| #1 | #2 | #3 | #4 |
|---|---|---|---|
| Peter | Paul | John | Barnabas |
| Timothy | Philip | Steven | Luke |
| John Mark | Matthew | Silas | James |

FIVE PLAYERS

| #1 | #2 | #3 | #4 | #5 |
|---|---|---|---|---|
| Peter | Paul | John | Barnabas | James |
| Timothy | Philip | Steven | Silas | Luke |
| | | | Matthew | John Mark |

SIX PLAYERS

| #1 | #2 | #3 | #4 | #5 | #6 |
|---|---|---|---|---|---|
| Peter | Paul | John | James | Silas | Steven |
| Timothy | Philip | Barnabas | Luke | Matthew | John Mark |

Each Apostle is represented by a game piece 12 to show his movement on the game board 10 and by a player board 15 to describe his abilities and keep track of his accomplishments. The game pieces 12 are preferably of another color, e.g., orange, to distinguish them readily from other marker pieces 16. Each game piece 12 states a different Apostle's name, and his assigned "movement factor".

The object of the game is the same as that of the early Apostles—to successfully spread Christianity throughout the world. This is accomplished by gaining a large number of "converts" and "deacons" by the end of the game. A convert is a new Christian, whereas a deacon is a mature Christian leader. The Apostles travel around the game board 10 preaching and writing so as to win converts in the various cities and then work with these converts to help them become deacons in their own churches. These converts and deacons are represented on the game board 10 by the following colored chips 17:

Blue Chip 21 - 1 convert
Red Chip 21*a* - 3 converts
Yellow Chip 22 - 1 deacon
White Chip 22*a* - 3 deacons To begin a new church, an Apostle must first win one or more converts. Then any Apostle can work with these converts by teaching or writing to enable them to become deacons. A convert is easiest to gain, but he is easily lost in times of persecution or trouble. To form strong churches which can endure persecution and grow on their own, it is absolutely necessary to turn some converts into deacons. Each city has a maximum number of church members (converts plus deacons) that it can have. The limits for each city are listed below in Chart B.

CHART B

MAXIMUM NUMBER OF CHURCH MEMBERS

| Western Region | | Central Region | | Eastern Region | |
|---|---|---|---|---|---|
| Rome | 20 | Nicaea | 4 | Seleucia | 4 |
| Puteoli | 8 | Troas | 4 | Antioch | 20 |
| Syracuse | 4 | Ephesus | 20 | Tyre | 4 |
| Malta | 4 | Colossae | 12 | Caesarea | 12 |
| Lasea | 4 | Patara | 4 | Damascus | 8 |
| Corinth | 12 | Attalia | 4 | Samaria | 8 |
| Athens | 8 | Perga | 4 | Joppa | 4 |
| Berea | 8 | Antioch of | 8 | Gaza | 4 |
| Thessalonica | 12 | Pisidea | | Jerusalem | 20 |
| Philippi | 12 | Iconium | 8 | Alexandria | 4 |
| Byzantium | 4 | Lystra | 8 | Paphos | 8 |
| | | Derbe | 8 | Salamis | 8 |
| | | Tarsus | 8 | | |

For simplicity's sake, it is suggested that chips 17 be kept on top of the stacks of chips in this order: white, yellow, red, and blue. Churches may only be formed in cities on the game board 10.

In most games the players oppose one another, but here the game itself provides the opposition for all the players through two sets of cards. The first set of cards are Conflict cards 23. The stack is shuffled once before the game starts. Then one Conflict card 23 is drawn each time one or more converts is won by an Apostle. Only one card is drawn even if the Apostle makes several converts at one time. Many Conflict cards are blank, indicating that no conflict has occurred. When directions are given, however, they must be followed as closely as possible. For example, just as in the book of Acts, some cards will require the Apostles to be "beaten", "stoned", "jailed", and even "martyred". If an Apostle is martyred, he is removed from the game. Then all churches within seven spaces 11 of the martyred Apostle have two converts become deacons. Then, if converts remain, two of them drop out of each church and are removed from the game board. As in real life, persecution and martyrdom makes some converts grow stronger (e.g., they become deacons) and makes others leave the church. The player keeps each Conflict card 23 that he draws until he has completed its directions. Then it is placed at the bottom of the deck.

One Event card 24 is drawn at the end of each game turn (not player turn). Many of these cards add to the historical nature of the game by directing an event that actually occurred in the books of Acts. The directions are followed as quickly and closely as possible. As with all the directions, common sense must be used. If a card calls for a particular church to lose two converts, but it has only one convert, then only one is lost. If that church has no converts, the card is ignored.

To overcome the opposition provided by the cards and to spread Christianity through the world successfully, each of the 12 Apostles is given six different abilities or ministries: Movement, Preaching, Teaching, Letter Writing, Gospel Writing, and Conflict Management. During each turn, an Apostle may move and use one of his other five abilities. The specific rules concerning each ability are explained below.

All movement is restricted to the land and sea routes marked on the game board. Unlike many games, movement is not determined by a roll of dice. Each Apostle has a specific movement factor noted on his game piece 12 and his player board 15. Land travel simply requires one movement factor per space 11 traveled. Sea travel is twice as fast: two spaces per movement factor. So an Apostle with a movement factor of 12 (like Paul) can travel 12 spaces on a road, but 24 spaces on a sea route.

There are certain restrictions regarding sea travel. To move by sea the Apostle must begin his turn in a port or seaside space and move directly into the water. Thus, when moving from land to sea, he must end land travel in a port or seaside space and is only allowed to begin sea travel on the following turn. This simulates waiting to embark on a ship.

When finishing a sea journey, an Apostle may continue moving onto land routes without stopping. For example, Paul has 12 movement factors. If he has used 8 of his movement factors to travel 16 spaces along a sea route and lands in Puteoli, he can still use his 4 remaining movement factors to travel 4 spaces on the land route and reach Rome on the same turn.

While moving along a sea route the Apostle may bypass ports only if the sea route bypasses them. If the sea route only passes through the port (e.g., Malta), the Apostle must stop his journey at the port and can only resume sea travel on the next turn.

All playing pieces may move over other pieces or even occupy the same space with them at any time.

When an Apostle arrives in a city, he will often want to start a church or strengthen an already existing church by winning converts. This is done by preaching. After the player states that his particular Apostle is going to preach, the dice are rolled and the total is compared to the Apostle's rating for preaching (see Apostle's player board 15 to determine the number of converts won). The results are as follows:

if rating is less than dice total—0 converts;
if rating is equal to or one greater than the dice total—1 convert;
if rating is two or three greater than the dice total—2 converts;

if rating is four or five greater than the dice total—3 converts;

if rating is six or seven greater than the dice total—4 converts; and if rating is eight or nine greater than the dice total—5 converts.

If some converts are won, the appropriate number of convert chips 21 and 21*a* is placed (blue and red chips) on the city space 11.

As previously mentioned, a church needs deacons as well as converts to be a strong church and survive persecution. One way to gain deacons is to "teach" converts. To do this, a player moves his Apostle piece to a city containing a church with at least one convert. He then declares that his Apostle is teaching and he rolls the dice. The results are:

if rating is less than dice total—0 converts become deacons;

if rating is equal to or one, two or three greater than the dice total—1 convert becomes a deacon; and if rating is four or more above dice total—2 converts become deacons.

Because a deacon is always a mature convert, one convert chip 21 is removed each time a deacon chip 22 is added to the board. If a city contains no converts, no deacons can be added to the church there.

The Apostles wrote many letters to help strengthen various churches during the first century of Christianity. Many of these letters or epistles are found today in the New Testament (e.g., Philippians was Paul's letter to the church at Philippi). In this game, an Apostle may choose to spend some of his turns "writing" instead of preaching, teaching, etc. To begin writing a letter, a player chooses a marker piece 16 marked "Letter" 18 and records the number of the letter (e.g., the Apostle's "first" letter) on his player board. He also records the church for which his letter is intended. Letters may only be written to cities which already have a church established. The dice are rolled and the total is compared to the Apostle's letter writing ability. The lower of the two numbers represents the number of chapters completed. Eight chapters are required to complete a letter. The number of chapters completed is recorded on the Apostle's player board 15. Usually one, two, or three turns are required to complete the letter.

When the eight chapters are completed, the "Letter" marker 18 is placed face down in the same space with the author. During the author's next turn, the marker is turned face up and begins its journey to its intended city moving just as an Apostle would with a movement factor of 12. The letter moves by itself. This simultes mail delivery. The letter becomes effective immediately upon arrival in its intended city; one die is rolled on that turn and on every succeeding turn by the author and the results from the following "Writing Chart" (Chart C) are followed:

CHART C

| | WRITING CHART | | | |
|---|---|---|---|---|
| (Key - | 1C = One Convert Gained | | 1D = One Deacon) Gained | |
| Die Roll | Letter | Gospel - City | Gospel - Country | Gospel - Region |
| 1 | — | — | — | — |
| 2 | — | 1C | — | — |
| 3 | — | 1C | 1C | 1C |
| 4 | 1D | 1C | 1C | 1C |
| 5 | 1D | 1C | 1C | 1C |

CHART C-continued

| | WRITING CHART | | | |
|---|---|---|---|---|
| (Key - | 1C = One Convert Gained | | 1D = One Deacon) Gained | |
| Die Roll | Letter | Gospel - City | Gospel - Country | Gospel - Region |
| 6 | 1D | 1C + 1D | 1D | 1D |

If the church for which the letter is intended ever loses all its members, the letter is eliminated from the game.

An Apostle may write as many letters as he wants. The Apostle's player board 15 has room to record three letters; others may be recorded on the back of the card. There are no restrictions on how many letters may be written to a particular church.

A gospel consists of 20 chapters and is written just like a letter, except that the lower number between the dice total and the Apostle's gospel writing ability is used. Its progress is recorded in the appropriate space on the Apostle's player board 15. While the author is writing a gospel, he must remain in a city with a church of at least four deacons and ten total members (converts and deacons). If the church membership drops below that figure at any time, the gospel writing must be suspended until membership returns to the required number. If the Apostle discontinues his writing and leaves the city, he must return to the same city before continuing work on his gospel. When the gospel is completed, a gospel marker 20 is placed on that city and the gospel becomes effective immediately. The author should mark that turn on his player board 15 with a "G" for "gospel". For that turn and the following two turns, one die is rolled, and the results for that particular city are followed (see Chart C above). For the next three turns, the results are applied to all the cities in the entire region. Thus the effects of the gospel multiply throughout the game. Only one gospel may be written in any one particular city.

When a Conflict card 23 is drawn and it declares that a conflict has occurred, a yellow conflict marker 19 is placed on the church, and the church begins to lose members each turn. This loss can be stopped only if one of the Apostles successfully uses his ability in conflict management. To do this, an Apostle must move to the city (or already be there) and declare that he is attempting to end the conflict. The dice are rolled, and if the Apostle's Conflict Management rating 46 is higher than the dice total, the conflict is over. If his rating is equal to or less than the dice total, the conflict and the resulting loss of members continue. Any number of Apostles may attempt to end the conflict as many times as desired until they are successful and the conflict marker is removed.

If the conflict is not ended, the loss of converts may continue until no converts remain in the church. In that case, the losses cease, but the marker remains and the losses will resume if any new converts are made in that church before the conflict marker is removed. Deacons are never lost through conflict.

The presence or arrival of a gospel or letter in the city eliminates the conflict after the initial loss of members.

The game consists of 20 game turns which may be recorded on the Game Turn section 44 of the player board 15. The 20 game turns approximately represent the time period from 30 A.D., just after the death of Jesus Christ, to 70 A.D. Each game turn consists of:

1. Individual player turns (moves clockwise around game board).
   a. Player moves one of his Apostles and uses one of his abilities if desired.
      i. Draw a Conflict card 23 if the Apostle has preached and made one or more converts.
      ii. If the Apostle has authored any letters, these may be moved.
      iii. Dice may be rolled for any gospel or letters the Apostle has completed.
   b. Player moves his other Apostles in the same manner. A player may move any, all, or none of his Apostles each turn.
   c. Other players move their Apostles in similar fashion.
2. Church phase-- If any church has three or more deacons, it can begin winning converts on its own during this phase of the game turn. Roll one die for every church with three or more deacons (at least one white chip 22*a*). If the number of deacons is greater than the die number, one convert is gained. If the number of deacons is equal to or less than the die number, no convert is gained. Each church has an absolute limit of six deacons which may not be raised even if the chance elements call for further additions.
3. Draw one Event card 24 and follow its directions as quickly and closely as possible. This completes one game turn.

As mentioned above, each Apostle has his own player board 15. Each Apostle's individual ability ratings 46 (for preaching, teaching, etc.) are found on these player boards. All the information about a gospel or letters written by the Apostle should be written on the board 15. Additionally, the player should mark the game turn in which the Apostle completes a letter or gospel, or the turn in which he is imprisoned, using the following key:

P =Prison
G =Gospel completed
L =Letter completed

For example, if John Mark completes a gospel during turn 13, a "G" would be placed next to the numeral 13 on the Game Turn section 44 of his player board 15. This would help the player remember that the dice roll for the gospel applied only to the one city during the first three turns (13, 14 and 15); applied to all the cities in that country during the next three turns (16, 17, 18); and applied to all the cities in the region during the remaining turns (19 and 20).

If an Apostle draws a Conflict card 23 which imprisons him during turn 6, a "P" would be marked at turn 6 on the Apostle's player board 15, and he would know that he would be in prison and unable to do anything but write during turns 7 and 8 but could resume movement and his other abilities during turn 9.

To begin the game, the game pieces 12 and player boards 15 are divided between participants as previously summarized. Four convert chips 21 are then placed in the Jerusalem space 30. Six of the Apostles—Peter 31, John 32, James 33, Steven 34, Matthew 35 and Philip 36—also begin the game in Jerusalem. The remaining six Apostles begin the game as follows:

Barnabas—begins in Jerusalem on the turn after Jerusalem has 3 converts and 3 deacons.

John Mark—begins in Jerusalem one turn after Barnabas.

Silas—begins in Antioch one turn after Antioch has 2 converts and 1 deacon.

Timothy—begins in Lystra on the turn after Paul or Silas makes the first convert in Lystra.

Luke—begins in Athens or Corinth on the turn after the first convert is made in either of these cities.

Paul—begins in Damascus on the turn after Damascus has 2 converts and 1 deacon.

The dice are rolled to determine which player goes first. Play proceeds clockwise around the board. The requirements for victory are summarized below in Chart D.

CHART D

| REQUIREMENTS TO WIN | | |
|---|---|---|
| Total Christians | Deacons | Result |
| 180 with at least | 60 | = Overwhelming Victory |
| 150 with at least | 55 | = Decisive Victory |
| 130 with at least | 50 | = Victory |
| 110 with at least | 40 | = Indecisive Standoff |
| 90 with at least | 30 | = Defeat |
| less than 90 converts or | 30 deacons | = Terrible Defeat |

(NOTE: Total Christians = converts + deacons)

Part of the educational value of the game is to discover the best strategy to spread Christianity around the world successfully. Therefore, detailed notes on strategy will not be given. A few general hints are to:

1. fulfill the requirements just listed to get the other six Apostles into the game.
2. build several strong churches in different regions of the game board and begin writing gospels as soon as the churches are large enough.

Many good suggestions may be discovered by reading the book of Acts in the Bible, upon which this game is based.

It will thus be seen that according to the present invention a game has been invented which includes the establishment and building up of churches on the game board with an attempt to maximize the point value associated with the number of converts and deacons "won" during the course of the game. While the preceding discussion represents the preferred embodiment of the invention, it will be apparent to those of ordinary skill in the art that many modifications may be made within the scope of the invention, said scope to be given the broadest interpretation of the following claims so as to encompass all equivalent structures and devices.

What is claimed is:

1. An educational and entertaining game for a number of participants, comprising:

a game board with a plurality of playing spaces arranged thereon, having indicia thereon associated with a part of the map of the world, a plurality of player boards, at least two for each participant, each player board having a plurality of sections with respective predetermined indicia including a first area with indicia designating a unique identity as amongst all said player boards and a second area with at least a space movement factor indicia assigned to the respective unique identity and a plurality of different ability factor indicia related to the abilities of the respective identity, at least two moveable game pieces per participant for movement from playing space to space on the game board, each game piece having two different kinds of indicia one of which is said unique identity and the other of which is said space movement factor indicia for determining the number of spaces the respective game piece may be moved by the respective participant for the respective unique identity, a plurality of marker pieces each having distinguishing indicia provided thereon to correlate said abilities for placement on various possible predesignated ones of said spaces to mark the achievement thereat of said unique identities, plurality of tallying pieces having different distinguishing indicia provided thereon for tallying certain conditions at said pre-designated spaces, first chance means for losing or gaining said tallying pieces, and second chance means for losing said tallying pieces immediately after they are gained.

2. A game as recited in claim 1, wherein said marker pieces are hexagonal in shape and their said distinguishing indicia provide three different types of marker pieces.

3. A game as recited in claim 2, wherein said marker pieces consist of a plurality of pieces of a first color with identifying indicia "Letter" associated therewith, a plurality of pieces of a second color with the indicia "Conflict" marked thereon and a plurality of pieces of a third color with "Gospel" written thereon.

4. A game as recited in claim 1, wherein said tallying pieces are circular plastic chips and wherein four different types of said different distinguishing indicia are provided thereon, providing four different types of tallying pieces.

5. A game as recited in claim 1, wherein each of said player boards is divided into five distinct areas including said first and second area, said five distinct areas having Apostle Name in said first section as said unique identity, Ability factors as aforesaid in said second area, Gospel, Game Turn and Letter provided as indicia thereon, and different other indicia being associated with each row, each player board employed for movement around the game board, accumulation of chips and recordation of each participant's accomplishments.

6. A game as recited in claim 1, wherein said playing spaces on said game board are hexagonal in shape and the game board includes route indicia forming both sea and land routes for player movement of said game pieces along said routes at a pace determined by the same movement factor of a game piece and whether the route is over land or sea, each game piece being able to move twice as fast by seas as by land.

7. A game as recited in claim 6, wherein said predesignated spaces are on said routes and certain ones are designated as different cities, one of said cities indicating the start of play in the game for a predetermined number of moveable game pieces.

8. A game as recited in claim 7, wherein said hexagonal playing spaces on said game board are disposed in a plurality of continuous paths having a plurality of cities thereon indicating the start of play for the remaining game pieces, at least one action or refusal to act by each moveable game piece which has entered the game being necessary to constitute one game turn.

9. A game as recited in claim 8, wherein said playing spaces on said game board are disposed in a plurality of continuous paths having various spaces thereof indicating the start of play of designated moveable game pieces, at least one action or refusal to act by each game piece that has entered the game being necessary to constitute one game turn, and wherein a point value is assigned to each tallying pieces earned dependent upon the indicia thereon, and wherein the indicia of all tallying pieces gained is added at the end of a predetermined number of game turns to determine whether together the participants have combined to defeat the board and win the game.

10. A game as recited in claim 1, further comprising a deck of Event cards as said first chance means, each card having a positive or negative effect associated therewith to be reflected by the gain or loss of tallying pieces at the end of each game turn.

11. A game as recited in claim 1, further comprising a deck of Conflict cards as said second chance means, each card either being blank or having a negative effect associated therewith, the latter to be reflected by the loss of a tallying pieces of single value immediately after any tallying pieces are gained in an individual player turn.

12. A game as recited in claim 1, further comprising a set of dice and a set of charts which allow each participant to determine how many tallying pieces are won in any particular individual game turn, a determination related to the difference between the roll of dice and the individual's ability factor.

13. An educational and entertaining game for a number of participants, comprising:

a game board displaying a part of the map of the world and having a multiplicity of playing spaces disposed on said map, a plurality of different player boards including at least one for each participant, each player board having a plurality of areas with respective predetermined indicia including a first area with indicia designating an identity unique as amongst all said player boards and a second area with at least a space movement factor indicia assigned to the respective unique identity and a plurality of different ability factor indicia related to the abilities of the respective identity, at least one moveable game piece per participant for movement from playing space to space on the game board, each game piece having two different kinds of indicia one of which is said unique identity for correlating the game pieces with respective player boards and participants and the other of which is said space movement factor indicia for determining the number of spaces the respective game piece may be moved by the respective participant for the respective unique identity, a plurality of marker pieces each having distinguishing indicia to correlate said abilities for placement on various possible predesignated ones of said spaces to mark the achievement thereat of said unique identities, a plurality of tallying pieces having different distinguishing indicia for tallying certain conditions at said predesignated spaces, first chance means for losing or gaining said tallying pieces, and second chance means for losing said tallying pieces immediately after they are gained.

* * * * *